US006880730B2

(12) United States Patent
Fulwood

(10) Patent No.: US 6,880,730 B2
(45) Date of Patent: Apr. 19, 2005

(54) STAND AND TWIST-TYPE CLOSURE CAP INCORPORATING SAME

(76) Inventor: Paul Robert Fulwood, 27 Quarry Street, Fremantle (AU), 6160

( * ) Notice: Subject to any disclaimer, the term of this patent is extended or adjusted under 35 U.S.C. 154(b) by 127 days.

(21) Appl. No.: 10/359,243

(22) Filed: Feb. 6, 2003

(65) Prior Publication Data

US 2003/0146249 A1 Aug. 7, 2003

(30) Foreign Application Priority Data

Feb. 7, 2002 (AU) ..... PS0363
Apr. 26, 2002 (AU) ..... PS1976

(51) Int. Cl.[7] ..... B67D 5/06

(52) U.S. Cl. ..... 222/186; 222/521; 222/548; 222/552

(58) Field of Search ..... 222/184, 186, 222/185.1, 181.1, 181.2, 521, 525, 548–549, 564, 519, 173, 563, 552–553

(56) References Cited

U.S. PATENT DOCUMENTS 1,590,636 A * 6/1926 McManus et al. ..... 222/105
3,777,948 A * 12/1973 Hafele ..... 222/497
3,984,035 A * 10/1976 Clarke ..... 222/497
4,383,623 A * 5/1983 Page, III ..... 222/521
4,823,994 A * 4/1989 Laauwe ..... 222/521
4,846,360 A 7/1989 Criste
4,930,668 A * 6/1990 Krall ..... 222/212
5,060,830 A * 10/1991 Krall ..... 222/212
5,118,012 A * 6/1992 Miller et al. ..... 222/105
5,180,083 A * 1/1993 Carlson ..... 222/185.1
5,261,567 A * 11/1993 Krall ..... 222/153.14
5,292,035 A * 3/1994 Millar ..... 222/173
5,340,228 A * 8/1994 Wilcox et al. ..... 401/262
5,431,305 A * 7/1995 Kaminski ..... 222/109
5,460,298 A 10/1995 DiBiase et al.
5,667,107 A * 9/1997 Lindsey ..... 222/173
5,715,877 A * 2/1998 Sandor ..... 141/307
5,964,376 A 10/1999 Kenosha
5,992,662 A 11/1999 Holt et al.
6,095,374 A 8/2000 Ricard et al.

FOREIGN PATENT DOCUMENTS

GB 1405591 9/1975
JP 8-282690 10/1996

* cited by examiner

*Primary Examiner*—Frederick Nicolas
(74) *Attorney, Agent, or Firm*—James Creighton Wray; Meera P. Narasimhan

(57) ABSTRACT

A twist-type closure cap for a container, the twist-type closure cap including a cap portion, and a stand portion, the cap portion including cap body rotatably mounted on a threaded central post having a bore therethrough with a bottom portion of the post being adapted to be secured to a container such that the container is in communication with the bore such that rotation of the cap body relative to the central post opens and closes the bore, and the stand portion comprising one or more legs, each leg being dependent from the cap body and extending radially outwardly therefrom, such that in use, the stand portion enables the container to maintain an inverted position whilst the or each leg thereof facilitates rotation of the cap body relative to the central post.

10 Claims, 5 Drawing Sheets

STAND AND TWIST-TYPE CLOSURE CAP INCORPORATING SAME

This application claims the benefit of Australian Provisional Application No. PS0363 filed Feb. 7, 2002 and Australian Provisional Application No. PS1976 filed Apr. 26, 2002.

FIELD OF THE INVENTION

The present invention relates to a stand and a twist-type closure cap for containers, said twist-type closure cap incorporating said stand. More particularly, the present invention relates to a stand and twist-type closure cap for containers that contain, or are intended to contain, viscous liquids.

BACKGROUND ART

Dispensing the last portions of a viscous liquid, such as shampoo or a condiment, from a container is frequently problematic. Inherently, viscous liquids take time to flow from the bottom of the container to the top from where they are dispensed, potentially causing frustration and often causing waste.

Over time, various techniques have been developed to at least partially overcome this problem. In some instances, shaking or forcefully hitting the container may be sufficient to propel the liquid towards the top of the container, from where the liquid may be dispensed. Heating the container and its contents to reduce the viscosity of the contents is another, albeit time consuming, approach. The container may also be stored in an inverted state, causing the contents of the container to pool adjacent to the opening of the container. However, given that containers are generally designed to be stable when upright, inverting containers in this manner can be precarious and even dangerous in the case of glass containers.

Twist-type closure caps comprise a cap body rotatably mounted on a threaded central post having a bore therethrough, a bottom portion of the post being adapted to be secured to a container such that the container is in communication with the bore, wherein rotation of the cap body relative to the central post opens and closes the bore. These caps are particularly useful in conjunction with flexibly resilient containers for dispensing viscous liquids as they allow the liquid to be expelled under pressure.

However, with existing twist-type closure caps, it may be difficult to rotate the cap body relative to the central post. Commonly, this is caused by a build-up of residual viscous liquid between the cap body and the post, dehydration of which results in an adhesive effect. However, where the user of the cap suffers from impaired dexterity, by way of arthritis or the like, the arrangement of the closure cap on the central post may simply be difficult to operate.

The present invention is directed to a twist type closure cap incorporating a stand adapted to facilitate dispensing the last portions of a viscous liquid from a container, whilst also facilitating the rotation of the cap body relative to the central post of the twist-type closure cap.

The preceding discussion of the background to the invention is intended to facilitate an understanding of the present invention. However, it should be appreciated that the discussion is not an acknowledgement or admission that any of the material referred to was part of the common general knowledge as at the priority date of the application.

Throughout the specification, unless the context requires otherwise, the word "comprise" or variations such as "comprises" or "comprising", will be understood to imply the inclusion of a stated integer or group of integers but not the exclusion of any other integer or group of integers.

DISCLOSURE OF THE INVENTION

In accordance with the present invention there is provided a twist-type closure cap for a container, the twist-type closure cap comprising a cap portion, and a stand portion, the cap portion comprising cap body rotatably mounted on a threaded central post having a bore therethrough with a bottom portion of the post being adapted to be secured to a container such that the container is in communication with the bore such that rotation of the cap body relative to the central post opens and closes the bore, and the stand portion comprising one or more legs, each leg being dependent from the cap body and extending radially outwardly therefrom, such that in use, the stand portion enables the container to maintain an inverted position whilst the or each leg thereof facilitates rotation of the cap body relative to the central post.

Accordingly, by enabling the container to be maintained in an inverted position, the closure cap enables gravity to cause any contents of the container to pool adjacent to the opening of the container, rendering such readily accessible. By extending radially outwardly from the cap body, the or each leg facilitates rotation of the cap body relative to the central post.

Preferably, the base portion comprises a plurality of legs, each leg depending from the engaging portion and extending radially outwardly therefrom. Preferably, the base portion comprises at least three legs. In a highly specific form of the invention, the base portion comprises three legs.

It has been found that the arrangement where the base portion is provided with three legs offers a good combination of stability and ease of rotation.

In one form of the invention, the stand portion is provided integrally with the cap body of the cap portion.

More specifically, the closure cap may be a twist lock adjustable metering closure cap wherein the degree of rotation of the cap body relative to the threaded central post determines the extent to which the bore is opened, such as that described in U.S. Pat. No. 4,967,941 (Beck, 6 Nov. 1990). The contents of U.S. Pat. No. 4,967,941 are hereby incorporated by reference.

In accordance with the present invention there is further provided a stand for a twist-type closure cap for a container, the twist-type closure cap comprising a cap body rotatably mounted on a threaded central post having a bore therethrough with a bottom portion of the post being adapted to be secured to a container such that the container is in communication with the bore and rotation of the cap body relative to the central post opens and closes the bore, the stand comprising an engaging portion having an aperture therethrough, and one or more legs, each leg being dependent from the engaging portion and extending radially outwardly therefrom, such that in use, the cap body is received through the aperture of the engaging portion thereby engaging the cap body with the stand, enabling the container to maintain an inverted position whilst the or each leg of the stand facilitates rotation of the cap body relative to the central post.

Preferably, the base portion comprises a plurality of legs, each leg depending from the engaging portion and extending radially outwardly therefrom. Preferably, the base portion comprises at least three legs. In a highly specific form of the invention, the base portion comprises three legs.

BRIEF DESCRIPTION OF THE DRAWINGS

The stand and closure cap will now be described, with reference to one embodiment of each, and the accompanying drawings, in which.

BEST MODE(S) FOR CARRYING OUT THE INVENTION

Figure 1:
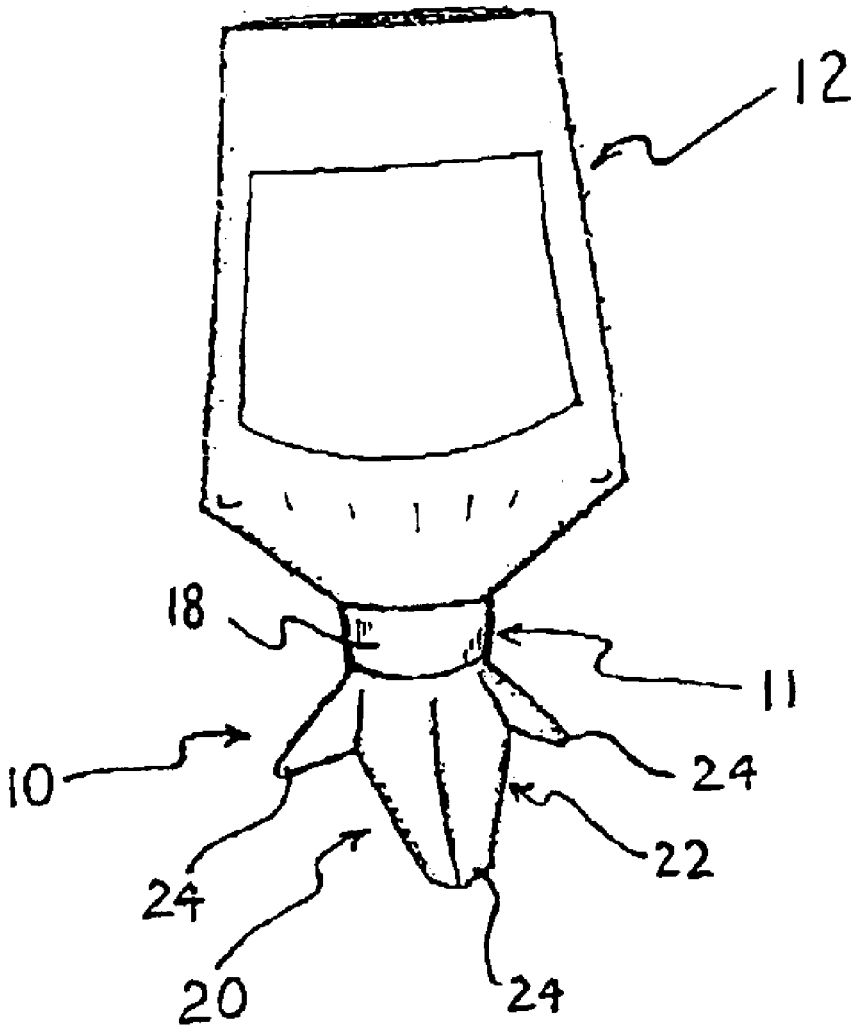
FIG. 1 is an upper perspective view of a closure cap attached to a container.
Figure 2:
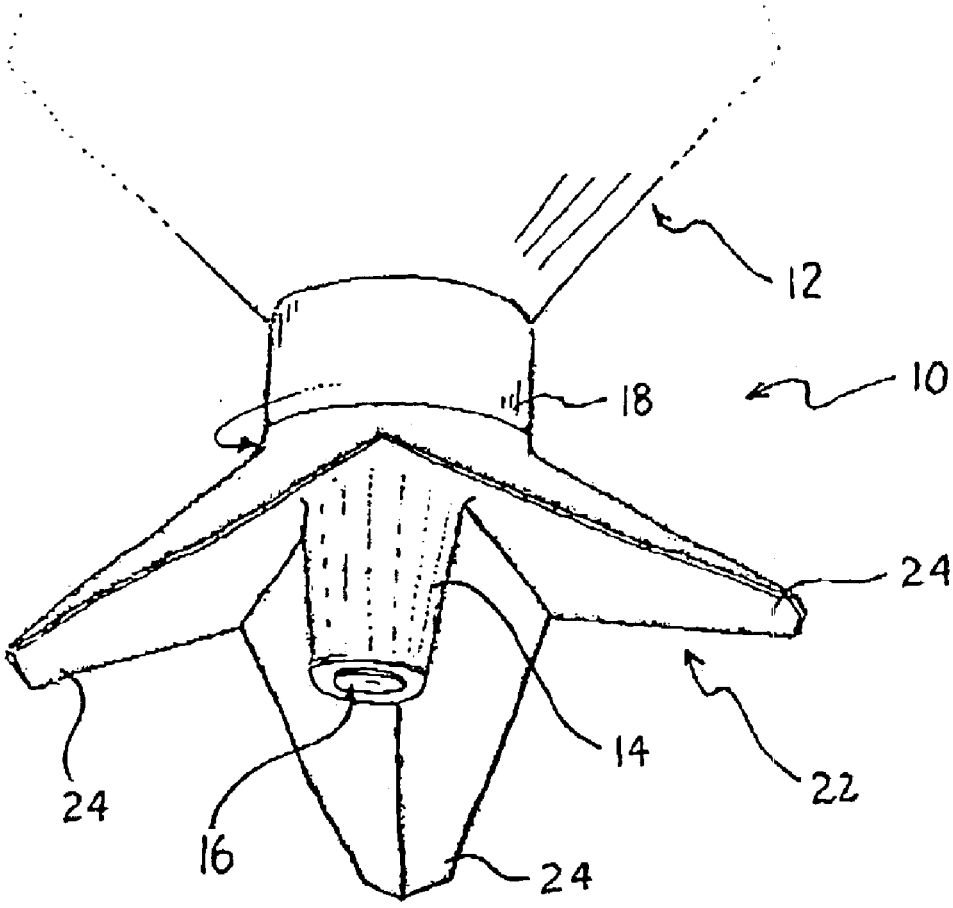
FIG. 2 is a lower perspective view of the closure cap of FIG. 1.
Figure 5:
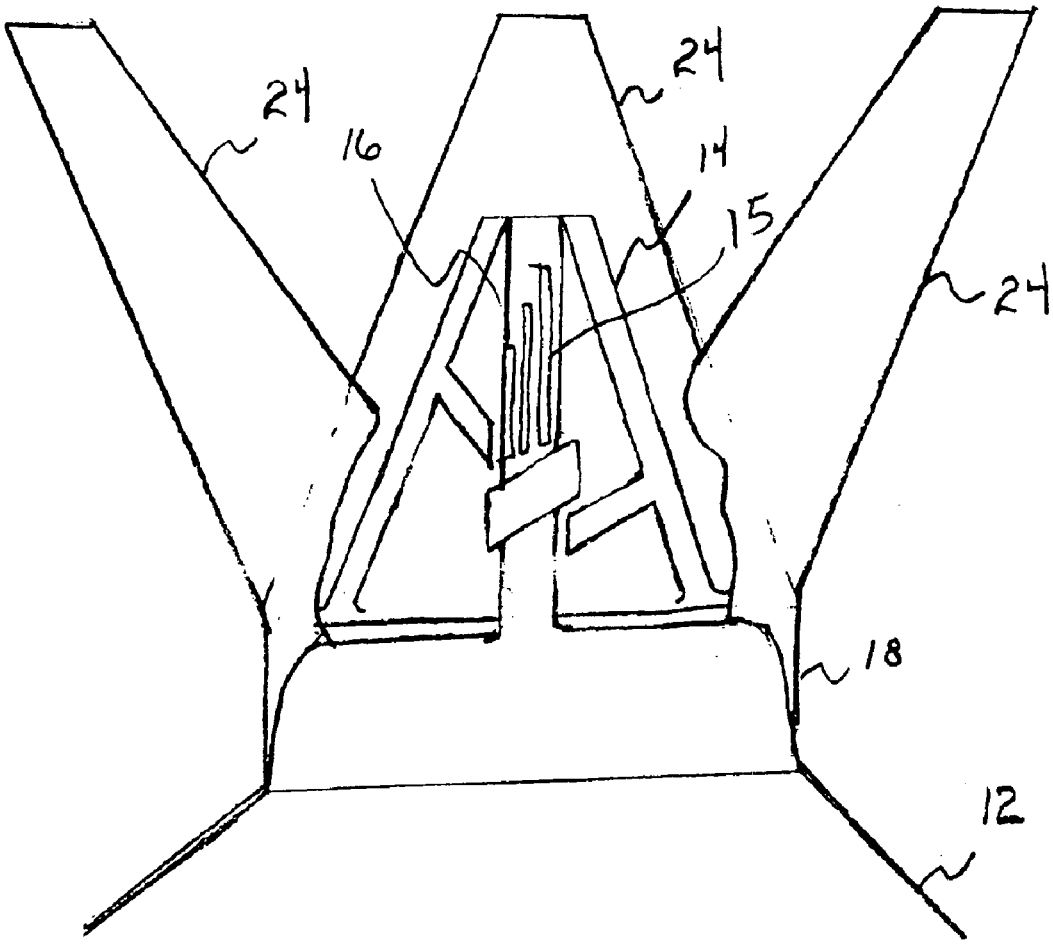
FIG. 5 is a partial cross-section the closure cap on the threaded central post between cut-out portions of the stand legs.

In FIG. 1 there is shown a closure cap 10, attached to a container 12 for dispensing a viscous liquid. As can best be seen in FIG. 2, the closure cap 10 comprises a cap portion 11 having a cap body 14 rotatably mounted on a threaded central post 16 having a bore (not shown) therethrough. A bottom portion 18 of the post 16 is secured to a container 12 such that the container 12 is in communication with the bore, and such that rotation of the cap body 14 relative to the central post 16 opens and closes the bore. FIG. 5 shows a partial cross-section of the closure cap 10 on the threaded central post 16 between cut-out portions of the stand legs 24. A degree of rotation of the cap body 14 relative to the threaded central post 16 determines an extent to which the bore 15 is opened.

The closure cap 10 further comprises a stand portion 20, in turn comprising an engaging portion in the form of the cap body 14 of the cap portion 11 and a base portion 22. The base portion 22 comprises three legs 24, mutually spaced about the circumference of the cap body 14, depending and extending radially outwardly therefrom.

In use, the base portion 22 of the stand portion 20 of the closure cap 10 enables the container 12 to be rested on a surface in an inverted position, causing the viscous contents of the container 12 to pool in the region of the closure cap 10. When the contents of the container 12 are required, a user (not shown) simply grasps the legs 24 and rotates the cap body 14 of the cap portion 11 relative to the central post 16 thereby opening the bore and allowing the contents to flow from the container 12. Regardless of the degree to which the contents of the container are depleted, the contents remain proximate the closure cap for convenient dispensing.

Further, the radial extension of the legs 24 from the cap portion 11 facilitates the rotation of the cap body 14 relative to the central post 16 by both providing a convenient place to grip the cap body 14, and reducing the amount of force required. This feature of the embodiment is particularly convenient for users of impaired dexterity, such as arthritis sufferers.

Figure 3:
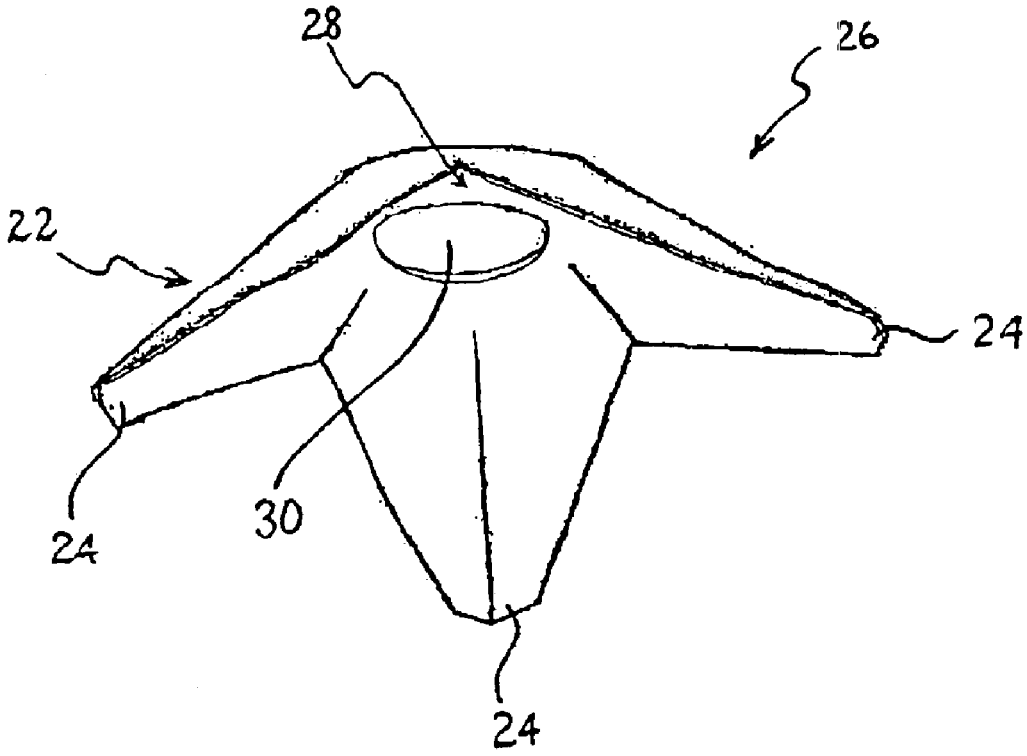
FIG. 3 is a lower perspective view of a stand in accordance with the embodiment.
Figure 4:
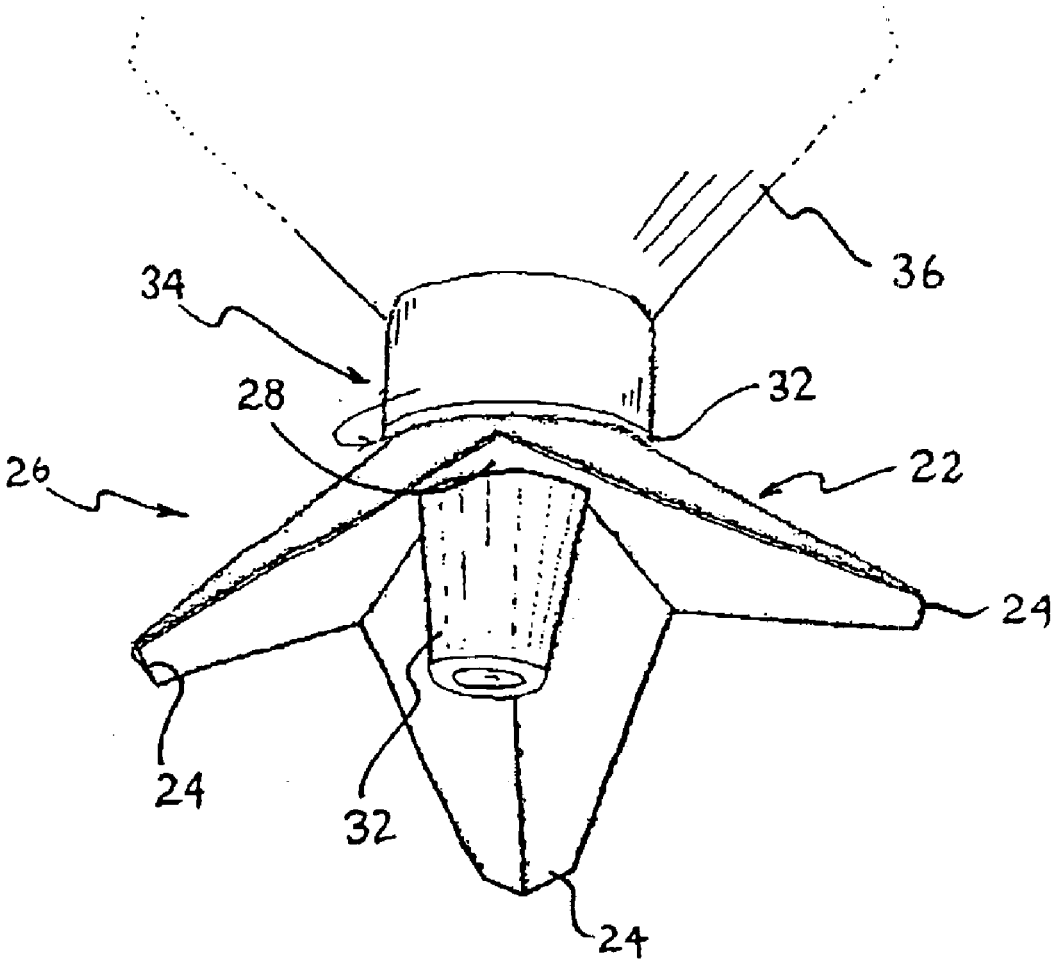
FIG. 4 is a further lower perspective view of the stand of FIG. 3 and a container received thereby.

In FIG. 3 there is shown a stand 26. The stand 26 is similar to the stand portion 20 of the closure cap 10, and like numerals will be used to denote like parts. However, unlike the stand portion 20, the engaging portion 28 of the stand 26 is not provided in the form of the cap body 14. Rather, the engaging portion 28 of the stand 26 is provided with an aperture 30 therethrough. As can best be seen in FIG. 4, the aperture 30 is dimensioned to at least partially receive therethrough a cap body 32 of a twist type closure cap 34 attached to a container 36.

In use, a user (not shown) inserts the cap body 32 of a twist type closure cap through the aperture 30 in the engaging portion 28 of the stand 26 until an interference fit is achieved, such that the stand 26 rotates in conjunction with the cap body 32. The stand 26 and twist type closure cap 34 combination is then used in a substantially identical manner to the closure cap 10. When the contents of the container 36 are exhausted, the stand 26 may be removed from the twist type closure cap and applied to a further twist type closure cap (not shown).

Modifications and variation such as would be apparent to the skilled addressee are considered to fall within the scope of the present invention.

What is claimed is:

1. A closure cap for a container, the closure cap comprising a cap portion, and a stand portion, the cap portion comprising a cap body rotatably mounted on a threaded central post having a bore therethrough with a bottom portion of the post secured to the container such that the container is in communication with the bore such that rotation of the cap body relative to the central post opens and closes the bore, and the stand portion comprising at least one leg, the at least one leg being dependent from the cap body and extending radially outwardly therefrom, such that in use, the stand portion enables the container to maintain an inverted position while the at least one leg facilitates rotation of the cap body relative to the central post, wherein a degree of rotation of the cap body relative to the threaded central post determines an extent to which the bore is opened.

2. The closure cap according to claim 1 wherein a base portion comprises a plurality of legs, each of the plurality of the legs depending from an engaging portion and extending radially outwardly therefrom.

3. The closure cap according to claim 2 wherein the base portion comprises at least three legs.

4. The closure cap according to claim 2 characterised in that the base portion comprises three legs.

5. The closure cap according to claim 1 characterised in that the stand portion is provided integrally with the cap body of the cap portion.

6. A stand for a closure cap for a container, the closure cap comprising a cap body rotatably mounted on a threaded central post having a bore therethrough with a bottom portion of the post secured to the container such that the container is in communication with the bore and rotation of the cap body relative to the central post opens and closes the bore, wherein a degree of rotation of the cap body relative to the threaded central post determines an extent to which the bore is opened, the stand comprising an engaging portion having an aperture therethrough, and at least one leg, the at least one leg being dependent from the engaging portion and extending radially outwardly therefrom, such that in use, the cap body is received through the aperture of the engaging portion thereby engaging the cap body with the stand, enabling the container to maintain an inverted position while the at least one leg of the stand facilitates rotation of the cap body relative to the central post.

7. A stand according to claim 6 wherein the base portion comprises a plurality of legs, each of the plurality of the legs depending from the engaging portion and extending radially outwardly therefrom.

8. A stand according to claim 7 wherein the base portion comprises at least three legs.

9. A stand according to claim 7 characterised in that the base portion comprises three legs.

10. A stand according to claim 6 characterised in that the stand portion is provided integrally with the cap body of the cap portion.

* * * * *